US005257860A

United States Patent [19]

Slivon

[11] Patent Number: 5,257,860

[45] Date of Patent: Nov. 2, 1993

[54] DRAWER LOCK MECHANISM INCLUDING PUSH BUTTON LATCH

[75] Inventor: George R. Slivon, Kenosha, Wis.

[73] Assignee: Snap-on Tools Corporation, Kenosha, Wis.

[21] Appl. No.: 938,392

[22] Filed: Aug. 31, 1992

[51] Int. Cl.[5] ..... E05B 65/46

[52] U.S. Cl. ..... 312/218; 312/219; 70/78

[58] Field of Search ..... 312/219, 218, 216, 217, 312/222, 333; 70/78, 79, 80, 81; 292/DIG. 18

[56] References Cited

U.S. PATENT DOCUMENTS

| | | | |
|---|---|---|---|
| 681,155 | 8/1901 | Tobey . | |
| 982,767 | 1/1911 | Dunham . | |
| 1,073,274 | 9/1913 | Millice . | |
| 1,823,536 | 9/1931 | Furlong . | |
| 1,911,564 | 5/1933 | Gahagan . | |
| 2,277,142 | 3/1942 | Osseler | 312/218 |
| 2,440,541 | 4/1948 | Gash . | |
| 2,804,364 | 8/1957 | Belew | 70/81 |
| 2,829,021 | 4/1958 | Wolters | 312/218 |
| 3,070,046 | 12/1962 | Paulos | 312/217 |
| 3,401,998 | 9/1968 | Evans et al. . | |
| 4,033,157 | 7/1977 | Williams | 312/218 |
| 4,850,208 | 7/1989 | Weinerman et al. . | |

*Primary Examiner*—P. W. Echols
*Assistant Examiner*—David P. Bryant
*Attorney, Agent, or Firm*—Emrich & Dithmar

[57] ABSTRACT

A cabinet has a plurality of drawers, each provided with a latch hook at its rear end which is receivable through a corresponding one of a plurality of apertures in a lock bar at the rear of the cabinet which vertically reciprocates between a lowered position interfering with the latch hooks to prevent opening of the drawers and a raised position accommodating free movement of the latch hooks through the apertures to permit opening of the drawers. A lock at the front of the cabinet rotates an elongated rod, the rear end of which engages a coupling bracket on the lock bar to lift it part way to its raised position, at the same time moving a sliding portion of the coupling bracket into position for engagement with a pivoting crank coupled to the rear end of a second spring-biased and push button-actuated rod. When the push button is depressed, the crank is pivoted to lift the lock bar the rest of the way to its raised position.

19 Claims, 4 Drawing Sheets

DRAWER LOCK MECHANISM INCLUDING PUSH BUTTON LATCH

BACKGROUND OF THE INVENTION

1. Field of the Invention

The present invention relates to drawer locking and latching mechanisms for cabinets and the like. The invention has particular application to tool cabinets.

2. Description of the Prior Art

Various types of locking and latching arrangements for multi-drawer cabinets have heretofore been used. Prior tool cabinets are commonly provided with a lock bar along the rear cabinet wall which engages the rear ends of the drawers, the lock bar being actuated between locked and unlocked conditions by a key lock at the front of the cabinet for simultaneously locking and unlocking all of the drawers. Such tool cabinets are typically mounted on rollers so that they can be moved about on the floor or other support surface. During such movement the drawers may accidentally slide open when in their unlocked condition as a result of tipping of the cabinet, sudden stops or starts or inclination of the floor.

It is known in other types of cabinets, such as filing cabinets and the like, to provide separate locking and latching mechanisms so that, after the drawers are unlocked, they must be separately unlatched before they can be opened. Such cabinets commonly have individual latch mechanisms on each drawer for this purpose. This, of course, adds to the expense of manufacture of the drawer.

It is also known to provide a common latch for simultaneously latching and unlatching a plurality of drawers and a separate lock which locks and unlocks the latch mechanism rather than the drawers. This, however, would require a major modification of a tool cabinet which uses the standard arrangement of a vertically reciprocating lock bar locked by a key lock in the front of the cabinet.

SUMMARY OF THE INVENTION

It is a general object of the invention to provide an improved cabinet and drawer locking and latching mechanism therefor, which avoids the disadvantages of prior mechanisms while affording additional structural and operating advantages.

An important feature of the invention is the provision of a locking and latching mechanism which permits a plurality of drawers to be simultaneously locked and unlocked but prevents an unlocked drawer from opening until it has been unlatched.

In connection with the foregoing feature, it is another feature of the invention to provide a cabinet of the type set forth which utilizes a standard vertically reciprocating lock bar for simultaneously locking all of the drawers.

Still another feature of the invention is the provision of a latch mechanism for simultaneously latching and unlatching all of the drawers after they have been unlocked.

In connection with the foregoing features, another feature of the invention is the provision of a cabinet of the type set forth which is of simple and economical construction.

These and other features of the invention are attained by providing in a cabinet having a drawer movable between open and closed conditions, the improvement comprising: a latch member carried by the cabinet and movable among first and second and third positions, the latch member in its first and second positions being engageable with the drawer in its closed condition for preventing opening thereof, the latch member in its third position accommodating free movement of the drawer between its open and closed conditions, first actuator means operable for moving the latch member between its first and second positions, and second actuator means for moving the latch member between its second and third positions.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
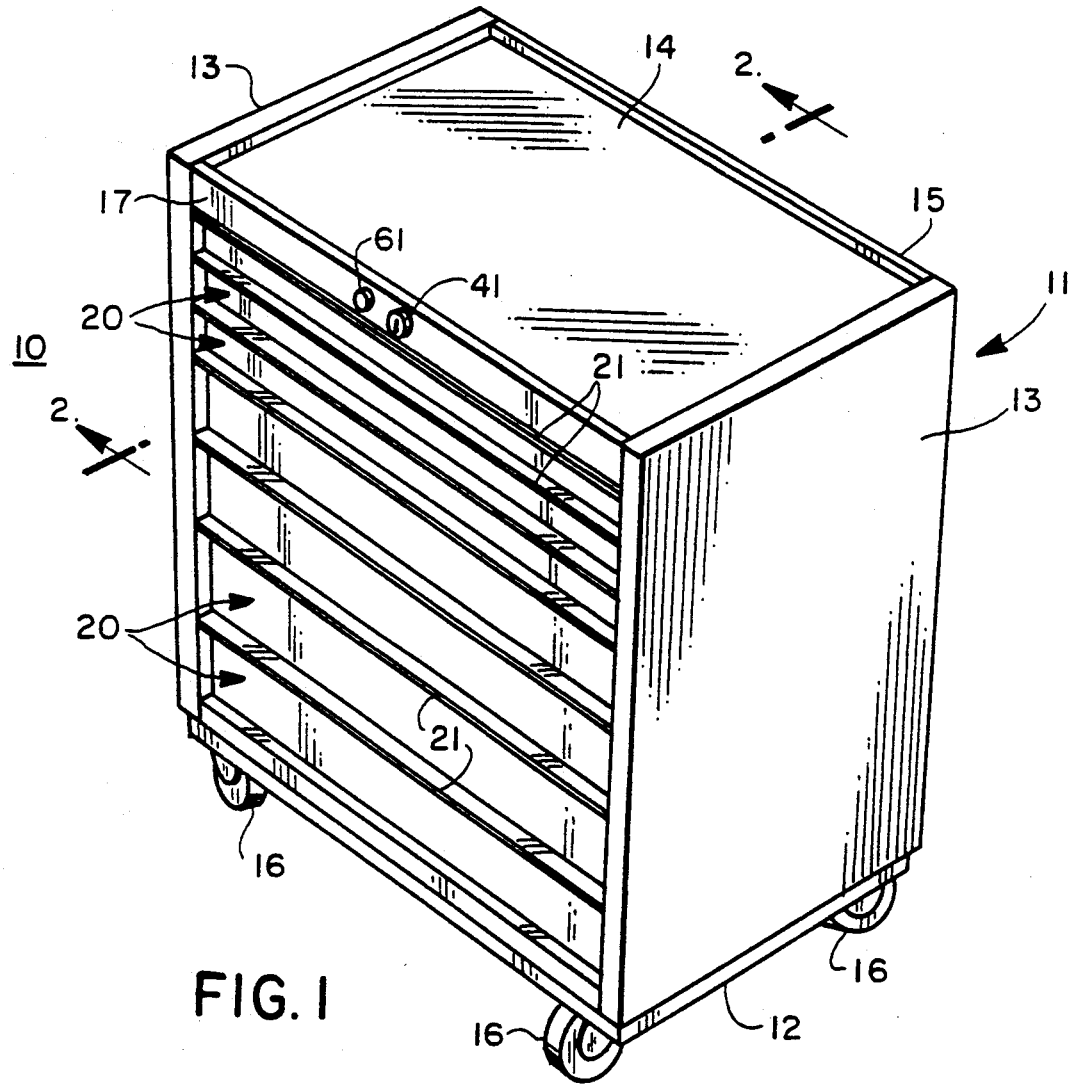
FIG. 1 is front perspective view of a tool cabinet constructed in accordance with and embodying the features of the present invention.

Referring to FIG. 1 there is illustrated a tool cabinet 10 construted in accordance with the present invention including a generally rectangular, box-like housing 11 having a bottom wall 12, a pair of opposed upstanding side walls 13 and a top wall 14 and closed at the rear end thereof by an upstanding rear wall 15. Fixedly secured to the bottom wall 12 and depending therefrom are a plurality of rollers 16 for accommodating rolling movement of the cabinet 10 about an underlying support surface or floor in a known manner. The cabinet 10 is also provided with a marginal peripheral front wall 17 which defines a front opening accommodating a plurality of drawers 20, each having a forwardly projecting handle 21 at the upper edge thereof.

Referring now also to FIGS. 2–7. each of the drawers 20 is preferably of shallow, open-top construction having an upstanding rear wall 23 provided centrally thereof with a rearwardly extending latch hook 25. The latch hook 25 has an upwardly projecting, generally triangular finger 26 which has a downwardly and rearwardly sloping cam surface 27 at the rear edge thereof and a vertical stop surface 28 at the front edge thereof, which is spaced a predetermined distance rearwardly of the rear wall 23 of the drawer 20. It will be appreciated that each of the drawers 20 is adapted for sliding movement between open and closed conditions on associated drawer slides (not shown) in a known manner.

The cabinet 10 is also provided with an elongated, vertically extending lock bar 30 which is generally hat-shaped in transverse cross-section, including a rectangular main wall 31 having a plurality of vertically spaced-apart rectangular apertures 32 therein (one shown). The main wall 31 is integral along its opposite side edges with rearwardly extending side walls 33, each of which is integral at its rear edge with a laterally outwardly extending flange 34. The lock bar 30 is mounted for vertically reciprocating movement in a guide track 35, which is generally channel-shaped and is mounted on the inner surface of the rear wall 15 of the cabinet 10. More specifically, the guide track 35 has laterally inwardly extending retaining flanges 36 which cooperate with the rear wall of the guide track 35 to define guide channels (see FIG. 5) for respectively slidably receiving the flanges 34 of the lock bar 30 and preventing forward displacement thereof from the guide track 35. In use, the lock bar 30 is arranged so that the apertures 32 therein are respectively disposed for receiving the latch hooks 25 of the drawers 20, all in a known manner.

It is a significant aspect of the invention that the cabinet 10 also includes a lock assembly 40, which includes a key lock 41 mounted on the front wall 17 of the cabinet 10 actuated by a key 42 for rotating a lever 43, commonly known as a "cam." The lever 43 is coupled to a front offset portion 44 of an elongated lock rod 45, which extends rearwardly substantially to the lock bar 30 just beneath the top wall 14 of the cabinet 10, and terminates in a rear offset portion 46. Preferably, the rod 45 extends through complementary apertures in front and rear hanger brackets 47 and 48, which may be respectively fixed to reinforcing channels 49 secured to the inner surface of the cabinet top wall 14 to accommodate rotation of the rod 45 between its locked and unlocked conditions. The lock assembly 40 includes a coupling bracket 50 which has a rectangular, horizontally disposed base plate 51, which may be integral, centrally thereof, with the main wall 31 of the lock bar 30 at its upper end so that the base plate 51 projects forwardly from the lock bar 30. Disposed immediately beneath the base plate 51 and parallel thereto is a rectangular slider plate 53 which has an elongated slot 54 therein for receiving therethrough a pin 55 for coupling the slider plate 53 to the base plate 51 for sliding movement of the slider plate 53 relative to the base plate 51. Depending from the slider plate 53 are two spaced-apart rectangular tabs 56 and 57. In use, the rear offset portion 46 of the rod 45 is disposed between the tabs 56 and 57.

Another important feature of the invention is that the cabinet 10 also includes a latch assembly 60 which is provided with a push button actuator 61 projecting from the front wall 17 of the cabinet 10 and fixedly secured to the forward end of an elongated rod 62, which extends rearwardly of the cabinet 10 substantially parallel to the lock rod 45 and has a rear end disposed for engagement with the forward leg 63 of a crank 65. The crank 65 is generally L-shaped, having its apex disposed upwardly, with the leg 63 sloping downwardly and forwardly relative to the cabinet 10 and being integral at its upper end with a leg 66 which slopes downwardly and rearwardly. The crank 65 has an attachment flange 64 which receives therein a pivot pin 67 projecting laterally from a hanger 68, which depends from the cabinet top wall 14 for pivotally supporting the crank 65. The latch assembly 60 also includes a helical tension bias spring 69 which has the rear end thereof secured to the attachment flange 64 and the front end thereof secured to the rear hanger bracket 48 for resiliently urging the crank 65 toward clockwise rotation about the pivot pin 67, as viewed in FIG. 2, for holding the leg 63 in engagement with the rear end of the rod 62.

Figure 2:
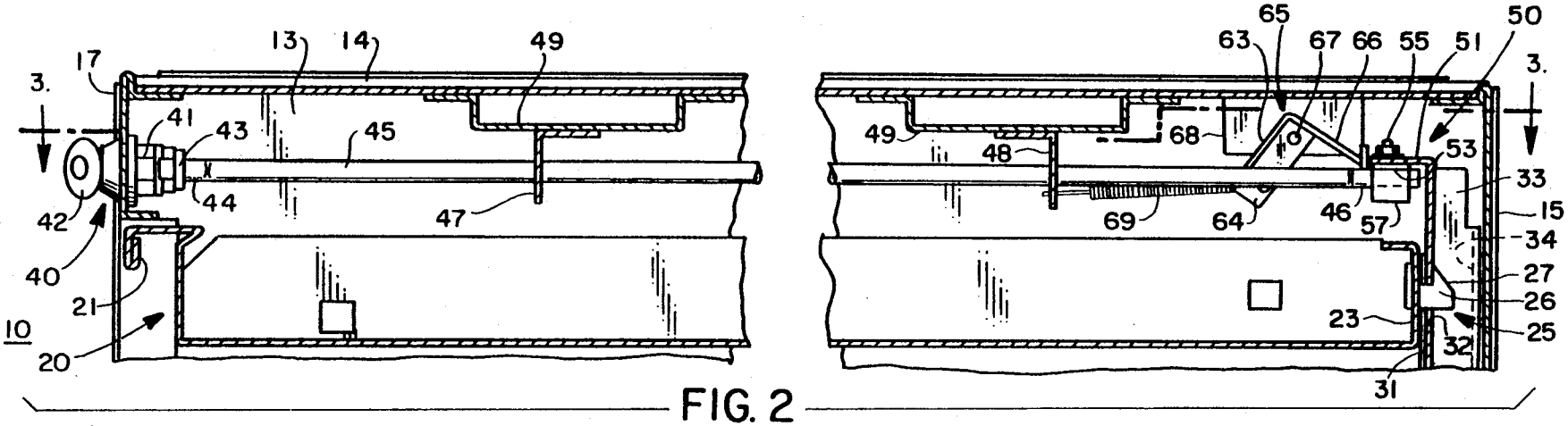
FIG. 2 is an enlarged, fragmentary view in vertical section, taken along the line 2—2 in FIG. 1, and illustrating the lock and latch assemblies of the present invention in their locked and latched configurations with the associated drawers closed.
Figure 3:
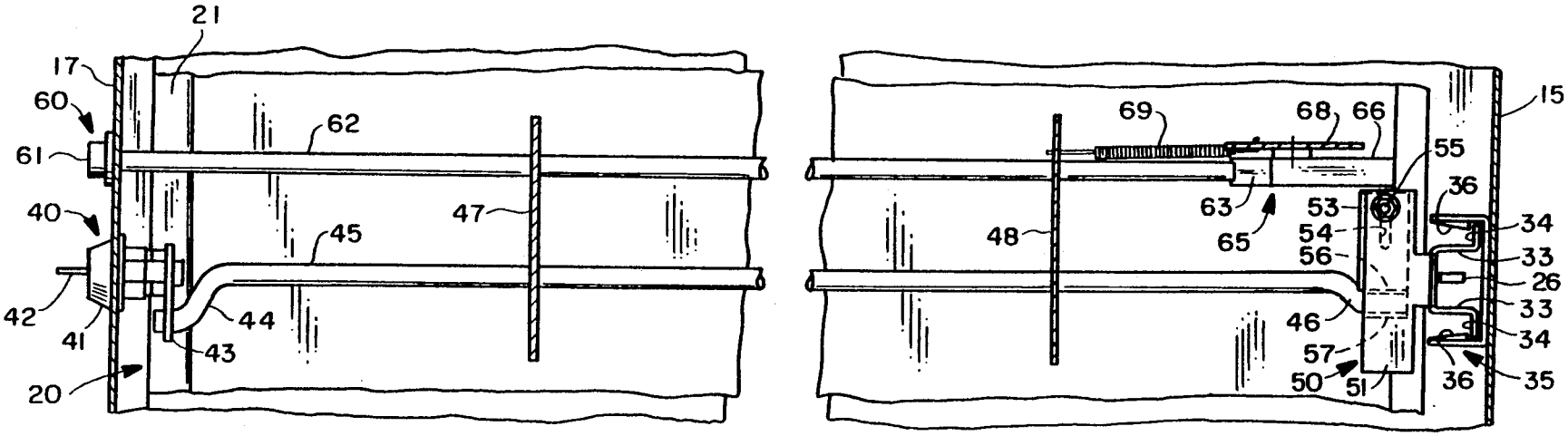
FIG. 3 is a fragmentary view in horizontal section taken along the line 3—3 in FIG. 2.

It will be appreciated that the lock bar 30 is biased by gravity and by a spring (not shown) to a first, lowermost locking position, illustrated in FIGS. 2 and 3 wherein, when the drawers 20 are closed, their latch hooks 25 are received respectively through the lock bar apertures 32, with the fingers 26 projecting upwardly above the upper edges of the associated apertures 32 for engagement of the stop surfaces 28 with the main wall 31 of the lock bar 30 to prevent opening of the drawers 20, all in a known manner. It will be appreciated that, when the lock bar 30 is disposed in this lowermost locking position, and a drawer 20 is open, the drawer 20 can be moved to its closed position without unlocking the lock assembly 40, the cam surface 27 camming the lock bar 30 momentarily upwardly to a raised unlatching position to permit free passage of the latch hook 25 through the lock bar aperture 32, whereupon the lock bar 30 will automatically drop back to its lowermost locked position.

Figure 4:
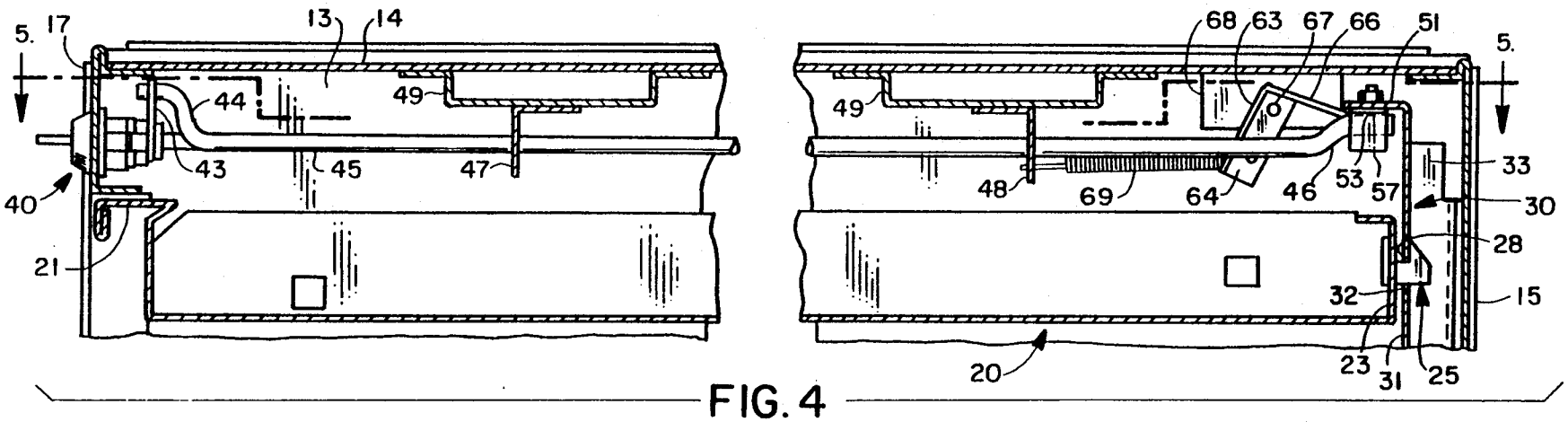
FIG. 4 is a view similar to FIG. 2 illustrating the lock assembly in its unlocked condition.
Figure 5:
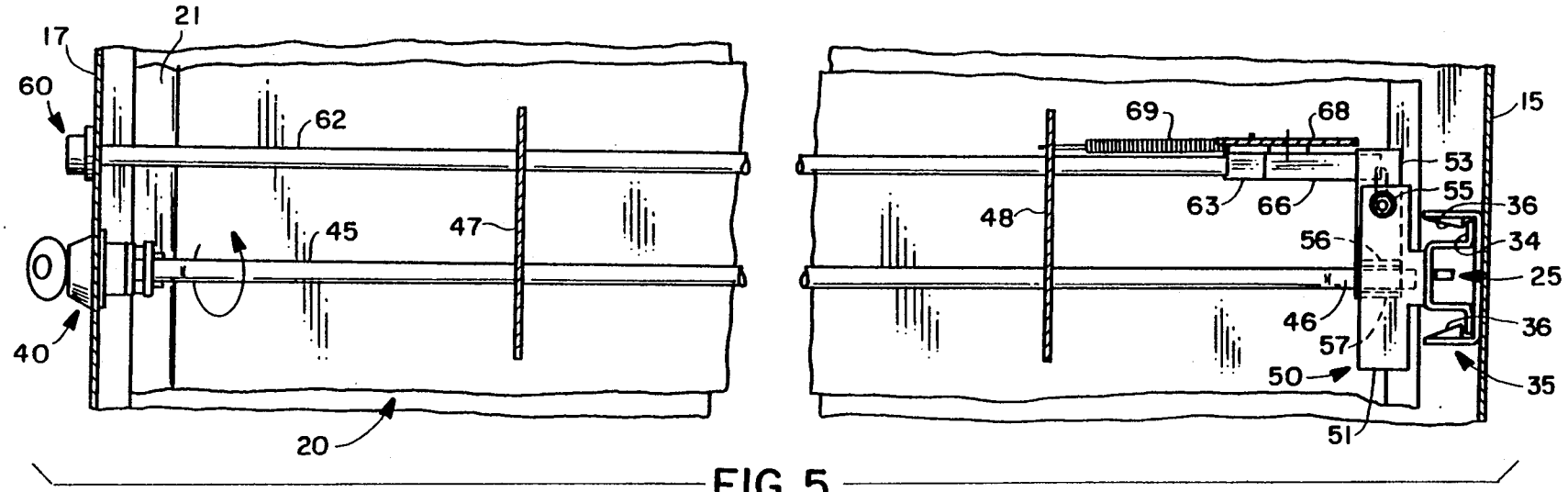
FIG. 5 is a fragmentary view in horizontal section taken along the line 5—5 in FIG. 4.

When the drawers 20 are locked closed, the lock assembly 40 is so disposed that the rear offset portion 46 of the lock rod 45 projects laterally to the side away from the latch assembly 60, as illustrated in FIG. 3. When the parts are in this condition, it can be seen that this offset portion 46 holds the slider plate 53 in a retracted position so that all parts of the coupling bracket 50 are clear of the crank 65, i.e., no part of the coupling bracket 50 overlies the crank 65. Referring in particular to FIGS. 4 and 5, when the key 42 is rotated to unlock the lock assembly 40, the lock rod 45 is rotated in a counterclockwise direction, as indicated by the arrow in FIG. 5, through an angle of approximately 90° so that the rear offset portion 46 lifts the base plate 51 of the coupling bracket 50 and thereby the lock bar 30 to an intermediate position, approximately halfway between the lowermost locked position and the raised unlatching position, so that the latch finger 26 of the hook 25 still engages the lock bar 30 to prevent opening of the drawer 20. During this unlocking movement of the rod 45, the rear offset portion 46 also engages the tab 56 for sliding the slider plate 53 to an extended position overlapping the leg 66 of the crank 65. Thus, it will be appreciated that while the lock assembly 40 has been unlocked, the drawers 20 are still prevented from sliding open. Thus, inadvertent opening of the drawers, such as during movement of the cabinet 10, is effectively prevented.

Figure 6:
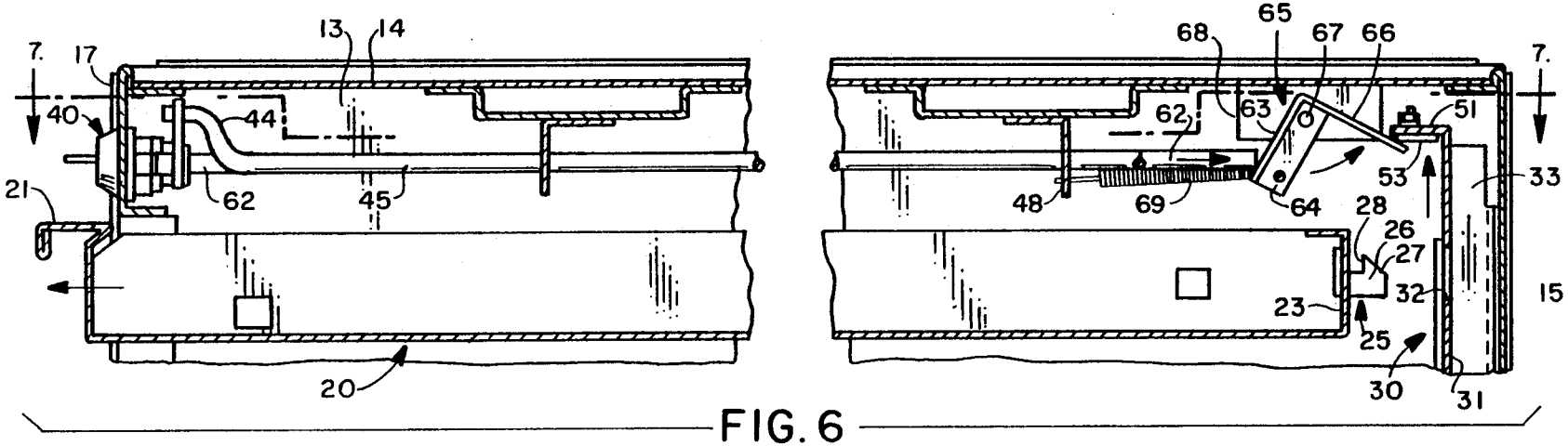
FIG. 6 is a view similar to FIG. 2 illustrating the latch assembly in its unlatching condition with an associated drawer shown partially open.
Figure 7:
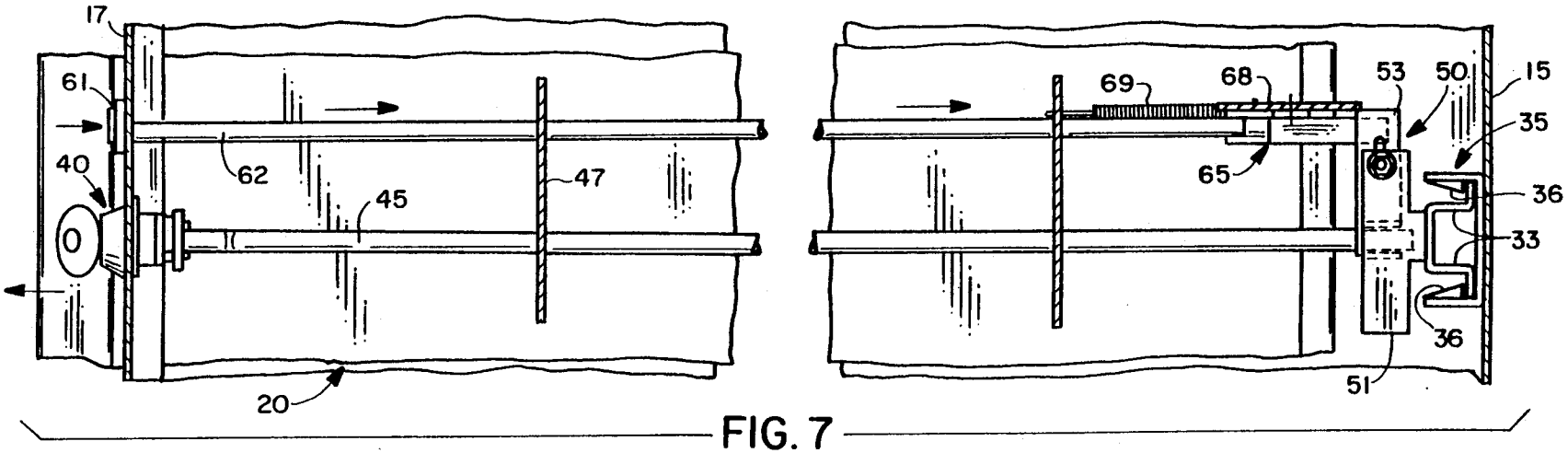
FIG. 7 is a fragmentary view in horizontal section taken along the line 7—7 in FIG. 6.

When it is desired to open one of the drawers 20, the push button actuator 61 of the latch assembly 60 is depressed, as indicated by the arrow in FIG. 7, thereby reciprocating the rod 62 rearwardly against the crank leg 63 and pivoting the crank 65 in a counterclockwise direction, as indicated by the arrow in FIG. 6. This causes the crank leg 66 to lift the slider plate 53, and thereby the lock bar 30, the rest of the way to its raised unlatching position. In this raised unlatching position, the latch hook 25 can freely move through the associated lock bar aperture 32, permitting the drawer 20 to be opened, as indicated in FIGS. 6 and 7. It will be appreciated that when the push button actuator 61 is released, the spring 69 will rotate the crank 65 in a clockwise direction back to its normal rest position, thereby pushing the rod 62 and the push button 61 back to their normal extended conditions and allowing the coupling bracket 50 and the lock bar 30 to drop back to their intermediate positions.

When the lock assembly 40 is relocked, the lock rod 45 will be rotated in a clockwise direction, the rear offset portion 46 thereof engaging the tab 57 to slide the slider plate 53 back to its retracted position and allowing the lock bar 30 to be lowered to its locked position.

From the foregoing, it can be seen that there has been provided an improved locking and latching mechanism for a drawer cabinet such that when the drawers are unlocked, a separate unlatching operation is required to permit a drawer to be opened, thereby effectively preventing inadvertent opening of a drawer during movement of the cabinet. The locking and latching mechanisms both operate on a standard single lock bar common to all the drawers in the cabinet.

I claim:

1. In a cabinet having a drawer movable between open and closed conditions, the improvement comprising: a latch member carried by the cabinet and movable among first and second and third positions, said latch member in its first and second positions being engageable with the drawer in its closed condition for preventing opening thereof, said latch member in its third position accommodating free movement of the drawer between its open and closed conditions, first actuator means carried by the cabinet and operable for moving said latch member between its first and second positions, and second actuator means carried by the cabinet and operable for moving said latch member between its second and third positions.

2. The cabinet of claim 1, wherein said latch member is vertically movable among said first, second, and third positions.

3. The cabinet of claim 2, wherein said latch member has an aperture therein, the drawer having a hook member thereon dimensioned to be receivable through said aperture when said latch member is in its third position.

4. The cabinet of claim 1, wherein said first actuator means includes a lock.

5. The cabinet of claim 1, wherein said second actuator means includes a push button disposed on the outside of the cabinet and an elongated rod connected to said push button for reciprocating movement thereby.

6. The cabinet of claim 1, wherein said first actuator means includes an enabling portion movable to an unlatch enabling position when said latch member is moved to its second position, said second actuator means including means engageable with said enabling portion in its unlatch enabling position for cooperation therewith to effect movement of said latch member to its third position in response to actuation of said second actuator means.

7. The cabinet of claim 1, and further including bias means resiliently biasing said second actuator means to a normal unactuated condition.

8. In a cabinet having a drawer movable between open and closed conditions, the improvement comprising: a latch member carried by the cabinet and movable among first and second and third positions, said latch member in its first and second positions being engageable with the drawer in its closed condition for preventing opening thereof, said latch member in its third position accommodating free movement of the drawer between its open and closed conditions, a first actuator member carried by the cabinet and movable between locking and unlocking conditions, a second actuator member carried by the cabinet and movable between latching and unlatching conditions, first coupling mechanism coupled to said latch member and responsive to movement of said first actuator member between its locking and unlocking conditions for effecting movement of said latch member between its first and second positions, said first coupling mechanism being movable to an unlatch enabling condition in response to movement of said first actuator member to its unlocking condition, and second coupling mechanism coupled to said second actuator member and disposed for engagement with said first coupling mechanism in its unlatch enabling condition, said second coupling mechanism cooperating with said first coupling mechanism in its unlatch enabling condition in response to movement of said second actuator member to its unlatching position for effecting movement of said latch member to its third position.

9. The cabinet of claim 8, and further comprising means mounting said first actuator member for rotational movement between the locking and unlocking conditions thereof.

10. The cabinet of claim 8, and further comprising means mounting said second actuator member for reciprocating movement between the latching and unlatching conditions thereof.

11. The cabinet of claim 8, and further comprising means mounting said second coupling mechanism for pivotal movement thereof.

12. The cabinet of claim 8, wherein said first coupling mechanism includes a first portion fixed to said latch member, and a second portion movable relative to said latch member to said unlatch enabling condition.

13. The cabinet of claim 8, and further comprising bias means resiliently urging said second coupling mechanism to a normal rest position for accommodating movement of said first coupling mechanism to its unlatch enabling condition.

14. In a cabinet having a plurality of drawers movable between open and closed conditions, the improvement comprising: a latch member carried by the cabinet and movable among first and second and third positions, said latch member in its first and second positions being engageable with all of the drawers in their closed conditions for preventing opening thereof, said latch member in its third position accommodating free movement of all of the drawers between their open and closed conditions, first actuator means carried by the cabinet and operable for moving said latch member between its first and second positions, and second actuator means carried by the cabinet and operable for moving said latch member between its second and third positions.

15. The cabinet of claim 14, wherein said latch member is vertically movable among the several positions thereof.

16. The cabinet of claim 15, wherein said latch member is an elongated bar disposed at the rear of the cabinet.

17. The cabinet of claim 16, wherein said bar has a plurality of vertically spaced apertures therethrough, each of the drawers having a latch hook at the rear end thereof adapted to be received through a corresponding one of said apertures when said bar is disposed in its first position.

18. The cabinet of claim 14, and further comprising bias means resiliently urging said second actuator means to a normal unactuated condition.

19. The cabinet of claim 15, wherein said first actuator means includes a lock, and said second actuator means includes a push button on the front of the cabinet and an elongated rod connected to said push button for reciprocating movement thereby.

* * * * *